US011348518B2

(12) United States Patent
Bao et al.

(10) Patent No.: US 11,348,518 B2
(45) Date of Patent: May 31, 2022

(54) METHOD FOR DRIVING DISPLAY PANEL AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Wenchao Bao, Beijing (CN); Min He, Beijing (CN); Chun Cao, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 208 days.

(21) Appl. No.: 16/616,195

(22) PCT Filed: May 20, 2019

(86) PCT No.: PCT/CN2019/087614
§ 371 (c)(1),
(2) Date: Nov. 22, 2019

(87) PCT Pub. No.: WO2019/223648
PCT Pub. Date: Nov. 28, 2019

(65) Prior Publication Data

US 2021/0335258 A1 Oct. 28, 2021

(30) Foreign Application Priority Data

May 23, 2018 (CN) ..... 201810500936.9

(51) Int. Cl.
*G09G 3/3233* (2016.01)

(52) U.S. Cl.
CPC ... *G09G 3/3233* (2013.01); *G09G 2300/0842* (2013.01); *G09G 2320/0233* (2013.01);
(Continued)

(58) Field of Classification Search
CPC ..... G09G 3/32; G09G 3/3225; G09G 3/3233; G09G 3/3258; G09G 3/3266;
(Continued)

(56) References Cited

U.S. PATENT DOCUMENTS 9,111,492 B2 * 8/2015 Kim ..... G09G 3/3233
9,727,186 B2 * 8/2017 Yang ..... G06F 3/04184
(Continued)

FOREIGN PATENT DOCUMENTS

CN 103187021 A 7/2013
CN 104332138 A 2/2015
(Continued)

OTHER PUBLICATIONS

First Office Action dated Sep. 25, 2019 corresponding to Chinese application No. 201810500936.9.

*Primary Examiner* — Michael J Eurice
(74) *Attorney, Agent, or Firm* — Nath, Goldberg & Meyer; Joshua B. Goldberg

(57) ABSTRACT

A method for driving a display panel and a display device are provided. The driving method includes supplying, during a data writing stage of each row of pixel circuits, a driving voltage VA[i] to the data line corresponding to each of the pixel circuits in a row, and supplying a compensation voltage VS to the second node of each of the pixel circuits in the row, and VA[i]=Vdata[i]+Vth[i]+VS, where Vdata[i] is an original data voltage of an $i^{th}$ pixel circuit of the pixel circuits, i is a positive integer, Vth[i] is a threshold voltage of the driving transistor of the $i^{th}$ pixel circuit, and a range from which a value of the compensation voltage VS is
(Continued)

selected is [−Vth_min, 0), and Vth_min is a minimum value among all of the threshold voltages of the driving transistors of the pixel circuits of the display panel.

16 Claims, 4 Drawing Sheets

(52) U.S. Cl.
CPC ..... *G09G 2320/0295* (2013.01); *G09G 2320/045* (2013.01)

(58) Field of Classification Search
CPC ..... G09G 3/3283; G09G 3/3291; G09G 2300/0426; G09G 2300/043; G09G 2300/0819; G09G 2300/0842; G09G 2320/0204; G09G 2320/0233; G09G 2320/0295; G09G 2320/043; G09G 2320/045; G09G 2330/021; G09G 2354/00
See application file for complete search history.

(56) References Cited

U.S. PATENT DOCUMENTS 9,983,755 B2* 5/2018 Yang ..... G06F 3/0412
2008/0278464 A1* 11/2008 Yamamoto ..... G09G 3/3233 345/204
2010/0259527 A1* 10/2010 Odawara ..... G09G 3/3233 345/211
2011/0063266 A1 3/2011 Chung et al.
2011/0063283 A1* 3/2011 Ryu ..... G09G 3/3283 345/214
2011/0109660 A1* 5/2011 Kim ..... G09G 3/3233 345/690
2011/0279444 A1* 11/2011 Chung ..... G09G 3/3233 345/214
2013/0169699 A1* 7/2013 Jeong ..... G09G 3/3225 345/690
2014/0333680 A1* 11/2014 Choi ..... H05B 45/60 345/690
2014/0354703 A1 12/2014 Han et al.
2015/0029171 A1* 1/2015 Jo ..... G09G 3/3258 345/212
2015/0179107 A1* 6/2015 Kim ..... G09G 3/3233 345/82
2015/0379923 A1* 12/2015 Lee ..... H01L 27/3272 345/206
2017/0018224 A1* 1/2017 Lee ..... G09G 3/3233
2017/0031485 A1* 2/2017 Kim ..... G09G 3/3233
2017/0061877 A1* 3/2017 Lee ..... H01L 27/3262
2017/0061892 A1* 3/2017 Jung ..... G09G 3/3291
2017/0116918 A1* 4/2017 Dong ..... G09G 3/3233
2017/0316738 A1* 11/2017 Sohn ..... G09G 3/3233
2017/0345368 A1* 11/2017 Kim ..... G09G 3/3233
2018/0004323 A1* 1/2018 Yang ..... G06F 3/04184
2018/0061293 A1* 3/2018 Park ..... G09G 3/3225
2018/0190194 A1* 7/2018 Zhu ..... H01L 27/3265
2019/0355802 A1* 11/2019 Shim ..... H01L 27/326

FOREIGN PATENT DOCUMENTS

CN 104361861 A 2/2015
CN 105096829 A 11/2015
CN 105895007 A 8/2016
CN 105913801 A 8/2016
CN 106652907 A 5/2017
CN 106782333 A 5/2017
CN 107039004 A 8/2017
CN 107358915 A 11/2017
CN 107978279 A 5/2018
CN 108766360 A 11/2018

* cited by examiner

METHOD FOR DRIVING DISPLAY PANEL AND DISPLAY DEVICE

CROSS-REFERENCE TO RELATED APPLICATION

The present application claims the priority to the Chinese Patent Application No. 201810500936.9, filed on May 23, 2018, the content of which is incorporated herein in its entirety by reference.

TECHNICAL FIELD

The present disclosure relates to the field of display technology, and more particularly, to a method for driving a display panel, and a display device.

BACKGROUND

As for a current display panel, an expected driving voltage on a data line is equivalent to a required original data voltage plus a threshold voltage of a driving transistor, and if a capability of a peripheral driving circuit is insufficient to drive the data line, i.e., the actual driving voltage on the data line does not reach the expected driving voltage, display distortion may occur.

SUMMARY

The present disclosure at least partially solves a problem of an excessive driving voltage required for a driving transistor in an existing display panel, and provides a method for driving a display panel, and a display device.

According to an aspect of the present disclosure, there is provided a method for driving a display panel including a plurality of pixel circuits arranged in an array, a plurality of data lines, and a plurality of first control lines, each of the plurality of pixel circuits comprising a first switching unit, a driving transistor, a storage unit, and a light emitting unit, first electrodes of the first switching units of the pixel circuits in a same column are coupled to a same data line, and control electrodes of the first switching units of the pixel circuits in a same row are coupled to a same first control line, and in each of the plurality of pixel circuits, a second electrode of the first switching unit is coupled to a first node of the pixel circuit; the driving transistor has a first electrode coupled to a first power supply, a second electrode coupled to a second node of the pixel circuit, and a control electrode coupled to the first node of the pixel circuit; the storage unit is coupled between the first node and the second node of the pixel circuit; and the light emitting unit is coupled between the second node of the pixel circuit and a second power supply, and the method includes during a data writing stage of the pixel circuits of each row, supplying a driving voltage to the data line corresponding to each of the pixel circuits in a row, and supplying a compensation voltage to the second node of the pixel circuit, and in an $i^{th}$ pixel circuit of the plurality of pixel circuits, i is a positive integer, the driving voltage VA[i]=Vdata[i]+Vth[i]+VS, Vdata[i] is an original data voltage of the $i^{th}$ pixel circuit, Vth[i] is a threshold voltage of the driving transistor of the $i^{th}$ pixel circuit, and a range from which a value of the compensation voltage VS is selected is [−Vth_min, 0), wherein Vth_min is a minimum value among all of the threshold voltages of driving transistors of the plurality of pixel circuits of the display panel.

According to embodiments of the present disclosure, the value of the compensation voltage VS is set to be equal to −Vth_min.

According to embodiments of the present disclosure, the method further includes: obtaining the threshold voltages of the driving transistors of the plurality of pixel circuits; and determining a minimum value among the obtained threshold voltages.

According to embodiments of the present disclosure, each of the plurality of pixel circuits further includes a second switching unit, and the display panel further includes a plurality of sensing lines and a plurality of second control lines, and first electrodes of the second switching units of the pixel circuits in the same column are coupled to a same sensing line, and control electrodes of the second switching units of the pixel circuits in the same row are coupled to a same second control line, and in each of the plurality of pixel circuits, a second electrode of the second switching unit is coupled to the second node of the pixel circuit, and the step of obtaining the threshold voltages of the driving transistors of the plurality of pixel circuits includes: supplying a first effective voltage to each of the plurality of first control lines, to turn on each of the first switching units coupled to the first control line; supplying a second effective voltage to each of the second control lines coupled to the pixel circuits of which the first switching units are turned on, to turn on each of the second switching units coupled to the second control line; supplying a first voltage to each of the plurality of data lines for turning on the driving transistors coupled to the first switching units which are turned on and keeping the light emitting units coupled to the driving transistors, which are turned on, being turned off; reading a second voltage on each of the sensing lines coupled to the second switching units which are turned on; and calculating the difference between the first voltage and the second voltage as the threshold voltage of a corresponding driving transistor.

According to embodiments of the present disclosure, the step of reading the second voltage on each of the sensing lines coupled to the second switching units which are turned on includes: obtaining a voltage on each of the sensing lines and taking the voltage, a value of which no longer changes, as the second voltage on the sensing line.

According to embodiments of the present disclosure, the step of during a data writing stage of the pixel circuits of each row, supplying a driving voltage to the data line corresponding to each of the pixel circuits in a row, and supplying a compensation voltage to the second node of the pixel circuit includes: supplying the first effective voltage to the first control line coupled to the pixel circuits in the row to turn on each of the first switching units coupled to the first control line; supplying the driving voltage to each of the plurality of data lines; supplying the second effective voltage to the second control line coupled to the pixel circuits in the row to turn on each of the second switching units coupled to the second control line; supplying the compensation voltage to each of the plurality of sensing lines; and supplying a turn-off voltage to the first control line and the second control line coupled to the pixel circuits in the row simultaneously, to turn off the first switching unit and the second switching unit of each of the pixel circuits in the row simultaneously.

According to embodiments of the present disclosure, the first switching unit is a first switching transistor, and the second switching unit is a second switching transistor.

According to embodiments of the present disclosure, the light emitting unit is a light emitting diode.

According to another aspect of the present disclosure, a display device is provided. The display device includes a display panel and a driving circuit for driving the display panel. The display panel includes a plurality of pixel circuits arranged in an array, a plurality of data lines, and a plurality of first control lines, and each of the plurality of pixel circuits includes a first switching unit, a driving transistor, a storage unit, and a light emitting unit; first electrodes of the first switching units of the pixel circuits in a same column are coupled to a same data line, and control electrodes of the first switching units of the pixel circuits in a same row is coupled to a same first control line, and in each of the plurality of pixel circuits, a second electrode of the first switching unit is coupled to a first node of the pixel circuit; the driving transistor has a first electrode coupled to a first power supply, a second electrode coupled to a second node of the pixel circuit, and a control electrode coupled to the first node of the pixel circuit; the storage unit is coupled between the first node and the second node of the pixel circuit; and the light emitting unit is coupled between the second node of the pixel circuit and a second power supply, and the driving circuit comprises a data line driving unit and a compensation unit, and during a data writing stage of the pixel circuits of each row, the data line driving unit is configured to supply a driving voltage to the data line corresponding to each of the pixel circuits in a row, and the compensation unit is configured to supply a compensation voltage to the second node of the pixel circuit, in an $i^{th}$ pixel circuit of the plurality of pixel circuits, i is a positive integer, the driving voltage VA[i]=Vdata[i]+Vth[i]+VS, Vdata[i] is an original data voltage of the is pixel circuit, Vth[i] is a threshold voltage of the driving transistor of the $i^{th}$ pixel circuit, and a range from which a value of the compensation voltage VS is selected is [−Vth_min, 0), and Vth_min is a minimum value among all of the threshold voltages of driving transistors of the plurality of pixel circuits of the display panel.

According to embodiments of the present disclosure, the value of the compensation voltage VS is set to be equal to −Vth_min.

According to embodiments of the present disclosure, the driving circuit further includes a detection unit configured to detect the threshold voltages of the driving transistors of the plurality of pixel circuits, and determine a minimum value among the obtained threshold voltages.

According to embodiments of the present disclosure, each of the plurality of pixel circuits further includes a second switching unit, and the display panel further includes a plurality of sensing lines and a plurality of second control lines; first electrodes of the second switching units of the pixel circuits in the same column are coupled to a same sensing line, and control electrodes of the second switching units of the pixel circuits in the same row are coupled to a same second control line, and in each of the plurality of pixel circuits, a second electrode of the second switching unit is coupled to the second node of the pixel circuit; the data line driving unit is configured to supply a first effective voltage to each of the plurality of first control lines, to turn on each of the first switching units coupled to the first control line; the compensation unit is configured to supply a second effective voltage to each of the second control lines coupled to the pixel circuits of which the first switching units are turned on, to turn on each of the second switching units coupled to the second control lines; the data line driving unit is configured to supply a first voltage to each of the plurality of data lines for turning on the driving transistors coupled to the first switching units which are turned on and keeping the light emitting units coupled to the driving transistors, which are turned on, being turned off; and the detection unit is configured to detect a second voltage on each of the sensing lines coupled to the second switching units which are turned on and calculate the difference between the first voltage and the second voltage as the threshold voltage of a corresponding driving transistor.

According to embodiments of the present disclosure, the detection unit is configured to detect a voltage on each of the sensing lines and takes the voltage, a value of which no longer changes, as the second voltage on the sensing line.

According to embodiments of the present disclosure, during the data writing stage of the pixel circuits of each row, the data line driving unit is configured to supply the first effective voltage to the first control line coupled to the pixel circuits in the row to turn on each of the first switching units coupled to the first control line, and supply the driving voltage to each of the plurality of data lines; the compensation unit is configured to supply the second effective voltage to the second control line coupled to the pixel circuits in the row to turn on each of the second switching units coupled to the second control line, and supply the compensation voltage to each of the plurality of sensing lines; and after the supplies of the driving voltage and the compensation voltage are finished, the data line driving unit and the compensation unit are configured to supply a turn-off voltage to the first control line and the second control line coupled to the pixel circuits in the row simultaneously, to turn off the first switching unit and the second switching unit of each of the pixel circuits in the row simultaneously.

According to embodiments of the present disclosure, the first switching unit is a first switching transistor, and the second switching unit is a second switching transistor.

According to embodiments of the present disclosure, the light emitting unit is a light emitting diode.

DETAILED DESCRIPTION

Figure 1:
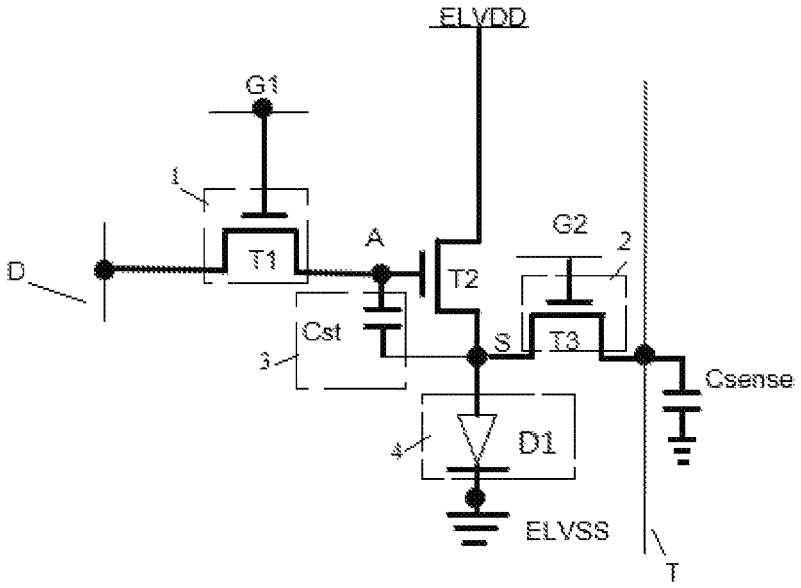
FIG. 1 is a circuit diagram of a display panel according to some embodiments of the present disclosure.

An Organic Light Emitting Diode (OLED) display panel includes a plurality of pixel circuits arranged in an array. Each pixel circuit includes at least one driving transistor coupled in series with a light emitting unit (e.g., an organic light emitting diode) between a first power supply and a second power supply. Each pixel circuit further includes a storage unit, such as a capacitor, having two ends coupled with a gate and a source of the driving transistor, respectively. After a driving voltage is written to the gate of the driving transistor through a data line, a connection between the data line and the driving transistor is broken, and a gate-source voltage difference of the driving transistor is maintained by the capacitor. A magnitude of a current flowing through the driving transistor (i.e., current flowing through a light emitting unit) is controlled by controlling a magnitude of the driving voltage, thereby controlling the luminance of the light emitting unit.

When the pixel circuit is used to display and a corresponding original data voltage is Vdata, during a data writing stage, the driving voltage provided to the gate of the driving transistor through the data line is Vdata+Vth (Vth is a threshold voltage of the driving transistor), and the source of the driving transistor is provided with 0V. Then connections between the gate of the driving transistor and the outside and between the source of the driving transistor and the outside are broken simultaneously, and the gate-source voltage difference Vgs of the driving transistor may be maintained due to the capacitor. Thus, a source-drain current I of the driving transistor is: $I=k\times(Vgs-Vth)^2=k\times(VA-VS-Vth)^2=k\times(Vdata+Vth-Vth-0)^2=k\times Vdata^2$, where k is a proportionality coefficient.

Since an expected driving voltage on the data line should be higher than the required original data voltage Vdata by a threshold voltage Vth, and if a power of a peripheral driving circuit is insufficient to drive the data line, i.e., the actual driving voltage on the data line does not reach the expected driving voltage, display distortion may occur.

Embodiments of the present disclosure may at least partially solve a problem of an excessively high requirement on a driving capability of the data line of the peripheral driving circuit in the related art.

In order to achieve a better understanding of technical solutions of the present disclosure, reference is made to the following detailed description taken in conjunction with the accompanying drawings.

Transistors according to the embodiments of the present disclosure may be thin film transistors or field effect transistors or other devices having the same characteristics, and since a source and a drain of the transistor are interchangeable in some conditions, descriptions of connection relationships for the source and the drain are indistinguishable. In the embodiments of the present disclosure, to distinguish the source and the drain of the transistor, one of the source and the drain is referred to as a first electrode, the other one is referred to as a second electrode, and the gate is referred to as a control electrode.

FIG. 1 is a circuit diagram of a display panel according to some embodiments of the present disclosure.

The display panel includes a plurality of pixel circuits arranged in an array, a plurality of data lines D, and a plurality of first control lines G1, and only one pixel circuit, one data line D, and one first control line G1 are shown in FIG. 1. Each pixel circuit includes a first switching unit 1, a driving transistor T2, a storage unit 3, and a light emitting unit 4. In the display panel, the first switching unit 1 in each of the pixel circuits in a same column is coupled to the same data line D to control a conduction or disconduction between a first node A and the corresponding data line D, and the first switching unit 1 in each of the pixel circuits in a same row are controlled by the same first control line G1. The driving transistor T2 has a first electrode coupled to a first power supply ELVDD, a second electrode coupled to a second node S, and a control electrode coupled to the first node A. The storage unit 3 is coupled between the first node A and the second node S. The light emitting unit 4 is coupled between the second node S and a second power supply ELVSS.

In order to achieve a clear understanding of the embodiments of the present disclosure, the following description is made by taking a first switching transistor T1 as an example of the first switching unit 1, taking a storage capacitor Cst as an example of the storage unit 3, and taking a light emitting diode D1 as an example of the light emitting unit 4. The light emitting diode D1 is, for example, an organic light emitting diode device or a micro light emitting diode device.

The control electrode of the first switching transistor T1 is coupled to the first control line G1, the first electrode of the first switching transistor T1 is coupled to the data line D, and the second electrode of the first switching transistor T1 is coupled to the first node A. The control electrode of the driving transistor T2 is coupled to the first node A, the first electrode of the driving transistor 12 is coupled to the first power supply ELVDD, and the second electrode of the driving transistor T2 is coupled to the second node S. Both ends of the storage capacitor Cst are coupled to the first node A and the second node S, respectively. The anode of the light emitting diode D1 is coupled to the second node S, and the cathode of the light emitting diode D1 is coupled to the second power supply ELVSS. The second power supply ELVSS is, for example, ground.

A method for driving the display panel according to an embodiment of the present disclosure includes: outputting, during a data writing stage of each row of pixel circuits, a driving voltage VA[i] to the corresponding data line D of each of the pixel circuits in the row, and outputting a compensation voltage VS to the second node S of each of the pixel circuits in the row, where VA[i]=Vdata[i]+Vth[i]+VS, "Vdata[i]" is the original data voltage of the $i^{th}$ pixel circuit, i is a positive integer; Vth[i] is the threshold voltage of the driving transistor T2 of the $i^{th}$ pixel circuit, and the threshold voltage of each of the driving transistors T2 is positive; and a range from which a value of the compensation voltage VS is selected is [−Vth_min, 0), where Vth_min is the minimum value among the threshold voltages of the driving transistors T2 in all of the pixel circuits of the display panel.

In the embodiment, the first control line G1 outputs an effective voltage (i.e., a voltage that can turn on the first switching unit 1) to turn on the first switching transistor T1, and the driving voltage VA[i] on the data line D is written to the first node A. The voltage difference Vgs[i] between the gate and the source of the driving transistor T2 of the it pixel circuit is:

$$\begin{aligned} Vgs[i] &= VA[i] - VS[i] \\ &= Vdata[i] + Vth[i] + VS - VS \\ &= Vdata[i] + Vth[i] \end{aligned}$$

Thereafter, the first node A and the second node S are simultaneously discoupled from the peripheral driving circuit. Because one end of the storage capacitor Cst is floating, the voltage difference between the two ends of the storage capacitor Cst is always VA[i]−VS[i]=Vdata[i]+Vth[i], thereby ensuring that the voltage difference Vgs[i] between the gate and source of the driving transistor T2 is always Vdata[i]+Vth[i]. Subsequently, since the light emitting diode D1 is turned on, the potential of the second node S and the potential of the first node A are both increased by a turn-on voltage of the light emitting diode D1, while the voltage difference between the second node S and the first node A are kept unchanged. A source-drain current of the driving transistor T2 (i.e., the current of the light emitting diode D1) is kept stable, and has a value I as follows:

$$I = k \times (VA[i] - VS[i] - Vth[i])^2$$
$$= k \times (Vdata[i] + Vth[i] + VS - VS - Vth[i])^2$$
$$= k \times Vdata^2$$

With the driving method according to the embodiment of the present disclosure, while an accurate control of luminescence of the light emitting unit 4 is achieved, the driving voltage required by the data line D is reduced (the reduced value is the absolute value of VS, so the driving voltage required for the data line D is reduced by at most Vth_min), thereby reducing the requirement on the driving capability of the data line of the peripheral driving circuit, and obtaining a more stable display performance.

The value of the compensation voltage VS cannot exceed the minimum value (i.e., Vth_min) among all of the threshold voltages of the driving transistors T2 in the display panel, which is to prevent the voltage difference between the first node A and the second node S in some pixel circuits from being always greater than the threshold voltage Vth of the driving transistor T2 so that the driving transistor T2 is always being turned on and thus a bright point defect occurs.

In the method of the embodiment, by selecting a most suitable range of the compensation voltage VS, the driving voltage required by the data line is reduced to the maximum extent without decreasing the display performance.

It should be noted that, the compensation voltage VS may be written into the second node S and maintained, and then the corresponding driving voltage Vdata[i]+Vth[i]+VS may be written into the data line D. Alternatively, the compensation voltage VS may be written into the second node S and the corresponding driving voltage Vdata[i]+Vth[i]+VS may be written into the data line D at the same time. Alternatively, the corresponding driving voltage Vdata[i]+Vth[i]+VS may be written into the data line D and maintained, and then the compensation voltage VS may be written into the second node S.

In one embodiment, the value of the compensation voltage VS is set to be −Vth_min. In this case, the driving voltage required for the data line D has a minimum value, and the requirement for the driving capability of the data line of the peripheral driving circuit is the lowest.

It should be noted that the present disclosure does not limit a circuit structure and a specific operation manner for outputting the compensation voltage VS to the second node S.

It should be noted that the minimum value Vth_min among the threshold voltages of the driving transistors 12 in all pixel circuits of the display panel may be obtained by sequentially detecting each driving transistor T2 experimentally. When there is a stable process condition, a part of the display panels in the same batch or model may be detected experimentally, and in default, the minimum value among the threshold voltages of the driving transistors T2 in the display panels in a same batch or model is a fixed value.

In one embodiment, the method for driving the display panel according to an embodiment of the present disclosure further includes: obtaining the threshold voltages of the driving transistors T2 of all pixel circuits; and determining a minimum value among all of the threshold voltages.

Since a detection circuit for detecting the minimum value among all of the threshold voltages may be integrated on the display panel, the minimum value Vth_min among all of the threshold voltages can be obtained by outputting an excitation signal to the display panel and reading a corresponding output signal without providing a dedicated detection device.

Referring to FIG. 1, the display panel further includes a plurality of sensing lines T and a plurality of second control lines G2 (only one sensing line T and one second control line G2 are shown in FIG. 1), and each pixel circuit further includes a second switching unit 2. In the display panel, the second switching units 2 of the pixel circuits in a same column are coupled to a same sensing line T, the second switching units 2 of the pixel circuits in a same row are controlled by a same second control line G2, and each of the second switching units 2 is coupled between the second node S and the sensing line T.

For the sake of clarity of the operation principle of the embodiment of the present disclosure, a second switching transistor T3 is taken as an example of the second switching unit 2. A control electrode of the second switching transistor T3 is coupled to the second control line G2, and a second electrode and a first electrode of the second switching transistor T3 are coupled to the second node S and the sensing line T, respectively. The equivalent capacitance Csense shown in FIG. 1 is an indication of the equivalent capacitance of the sensing line T with respect to ground or with respect to any other circuit structure, and is not a real capacitive device specially made for the sensing line T.

Figure 2:
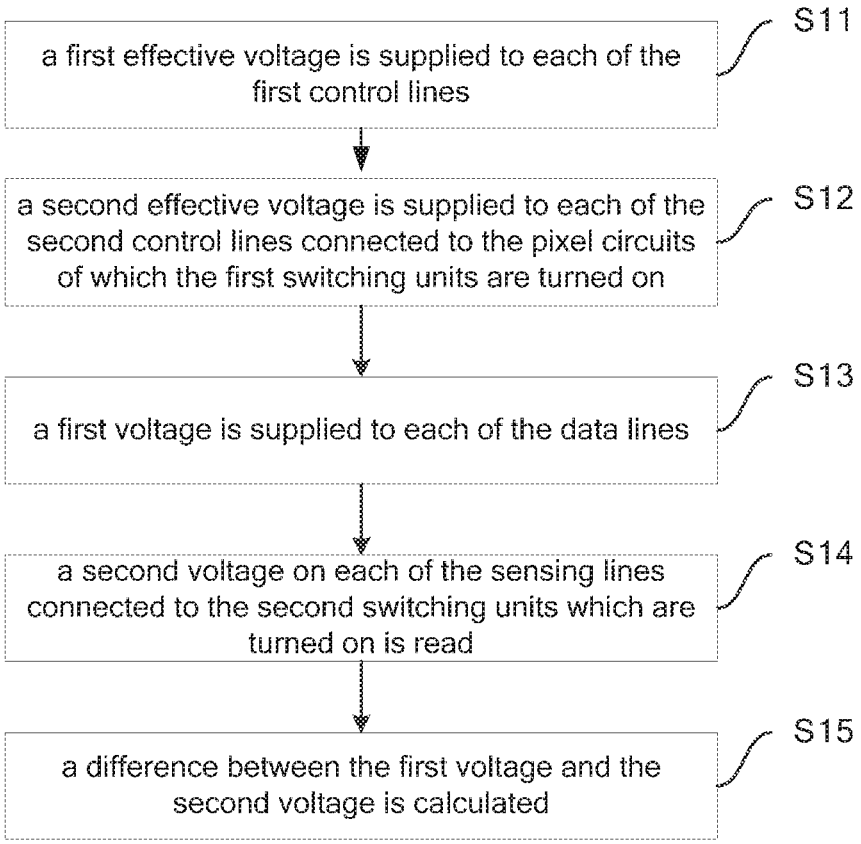
FIG. 2 is a flowchart of a detection stage in a method for driving a display panel according to some embodiments of the present disclosure.

FIG. 2 is a flowchart of a detection stage in the method for driving the display panel according to the embodiment of the present disclosure.

As shown in FIG. 2, in step S11, a first effective voltage (i.e., a voltage that may turn on the first switching unit 1, for example, if the first switching unit 1 is an N-type transistor, the first effective voltage has a high level) is supplied to each of the first control lines G1 to turn on the respective first switching units 1 coupled to the first control lines G1.

In step S12, a second effective voltage (i.e., a voltage that may turn on the second switching unit 2, for example, if the second switching unit 2 is an N-type transistor, the second effective voltage has a high level) is supplied to each of the second control lines G2 coupled to the pixel circuits of which the first switching units 1 are turned on, so that the respective second switching units 2 coupled to the second control line G2 are turned on.

In step S13, a first voltage is supplied to each of the data lines D, and the first voltage may turn on the driving transistors T2 coupled to the first switching units which are turned-on and may make the light emitting units 4 coupled to the driving transistors which are turned-on kept being turned off.

Taking FIG. 1 as an example, the first switching unit 1 is turned on (i.e., the first switching transistor T1 is turned on), and the data line D outputs the first voltage to the first node A (i.e., the control electrode of the driving transistor T2) through the first switching transistor T1, thereby turning on the driving transistor T2.

It should be noted that the first voltage should be smaller than a sum of the threshold voltage Vth of each of the driving transistors T2 and the threshold voltage of the light emitting diode D1, and only in this way, the light emitting diode D1, which can be equivalently regarded as a capacitor, will not be turned on in step S13. When a potential of the second node S increases up to the difference between a potential of the first node A and the threshold voltage Vth of the driving transistor T2, a potential of the second node S stops increasing. A value of the first voltage satisfying the above requirements can be determined experimentally.

In step S14, the second voltage on each of the sensing lines T coupled to the second switching units 2 which are turned on is read.

Referring to FIG. 1, after each of the second switching units 2 (i.e., the second switching transistors T3) of the pixel circuits in a same row is turned on, an external detection circuit can read the voltage at the second electrode (i.e., the second node S) of the driving transistor T2 through the sensing line T. An influence of the equivalent capacitance Csense of the sensing line T on the voltage of the second node S is negligible.

Obviously, if the voltage of the second node S detected in step S14 has not been stabilized yet, the voltage of the second node S can be continuously detected, and the voltage of which a value thereof no longer changes is taken as the second voltage. The voltage when a value thereof no longer changes herein is referred to a voltage that value thereof may change within an allowed accuracy.

In step S15, a difference between the first voltage and the second voltage is calculated as the threshold voltage of the corresponding driving transistor T2.

A difference between the first voltage and the second voltage may be read by a differential sample-and-hold circuit and converted into a digital signal via an analog-to-digital conversion circuit for subsequent calculation of the minimum value of the threshold voltages.

After the threshold voltages of the driving transistors T2 of all of the pixel circuits of the display panel are collected, the minimum value Vth_min is determined to be a basis for the subsequent voltage adjustment.

Figure 3:
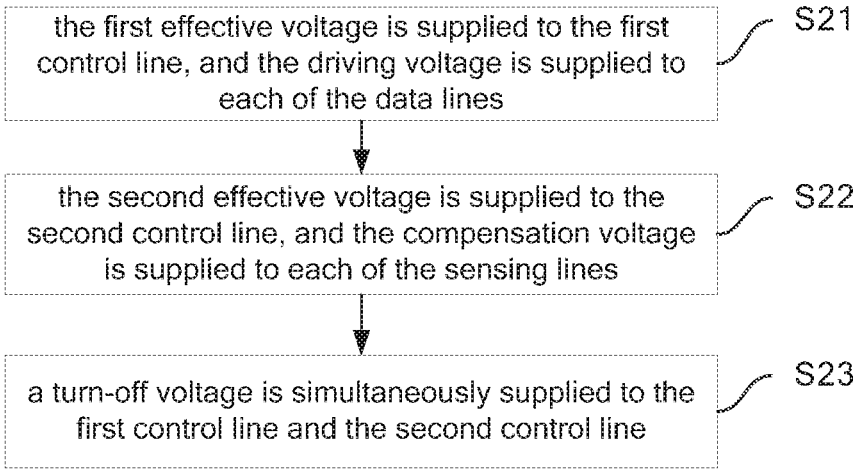
FIG. 3 is a flowchart of a writing stage in the method for driving the display panel according to some embodiments of the present disclosure.

FIG. 3 is a flowchart of a writing stage in the method for driving the display panel according to an embodiment of the present disclosure.

Referring to FIG. 3, in step S21, the first effective voltage is supplied to the first control line G1 to turn on the respective first switching units 1 coupled to the first control line G1, and the driving voltage is supplied to each of the data lines D.

In step S22, the second effective voltage is supplied to the second control line G2 to turn on the respective second switching units 2 coupled to the second control line G2, and the compensation voltage is supplied to each of the sensing lines T.

Referring to FIG. 1, a voltage of the control electrode of the driving transistor 12 is supplied from the data line D through the first switching transistor T1, and a compensation voltage of the second node S is supplied from the sensing line T through the second switching transistor T3.

In step S23, a turn-off voltage is simultaneously supplied to the first control line G1 and the second control line G2 to simultaneously turn off the first switching unit 1 and the second switching unit 2 in each of the pixel circuits.

Referring to FIG. 1, the first and second switching transistors T1 and T3 are simultaneously turned off, so that a voltage difference across the storage capacitor Cst is maintained, i.e., a voltage difference between the control electrode and the second electrode of the driving transistor T2 is maintained.

The circuit structure shown in FIG. 1 can be used not only to measure the threshold voltage of each driving transistor T2, but also to maintain the voltage difference between the control electrode and the second electrode of each driving transistor T2.

Figure 4:
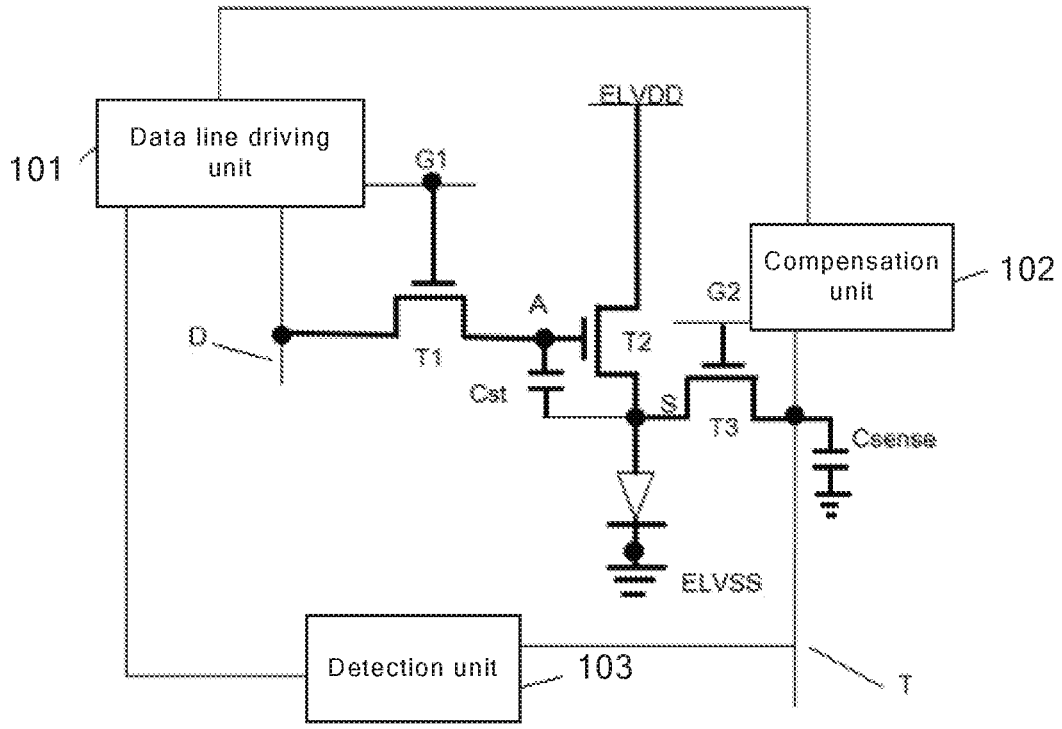
FIG. 4 is a circuit diagram of a display device according to some embodiments of the present disclosure.

FIG. 4 is a circuit diagram of a display device according to some embodiments of the present disclosure.

Referring to FIG. 4, the display device according to some embodiments of the present disclosure includes the display panel as shown in FIG. 1 and a driving circuit for driving the display panel. The driving circuit includes a data line driving unit 101 and a compensation unit 102.

In the data writing stage of each row of the pixel circuits, the data line driving unit 101 supplies the driving voltage VA[i] to the data line D corresponding to each of the pixel circuits in the row, and the compensation unit 102 supplies the compensation voltage VS to the second node S of each of the pixel circuits in the row, where VA[i]=Vdata[i]+Vth[i]+VS, and Vdata[i] is the original data voltage of the $i^{th}$ pixel circuit, i is a positive integer, Vth[i] is the threshold voltage of the driving transistor 12 of the $i^{th}$ pixel circuit, the threshold voltage of each driving transistor T2 is positive, a range of the compensation voltage VS is [−Vth_min, 0), and Vth_min is the minimum value among all of the threshold voltages of the driving transistors T2 in all of the pixel circuits of the display panel.

The display device can be any product having a display function, such as a mobile phone, a tablet, a television, a display, a notebook, a digital photo frame, a navigator and the like.

The data line driving unit 101 may be a source driver integrated chip (Source IC) for supplying different stable voltages to the control electrode of the driving transistor 12. The compensation unit 102 is also, for example, a source driver integrated chip (Source IC). The two source driver integrated chips are supplied with power through a power chip (Power IC), and control timings of the two source driver integrated chips may be implemented through a timing control chip (TCON).

In one embodiment, the value of the compensation voltage VS is set to be −Vth_min.

In one embodiment, referring to FIG. 4, the driving circuit further includes a detection unit 103 for detecting a threshold voltage of each of the driving transistors T2 and determining the minimum value Vth_min among the threshold voltages.

In one embodiment, referring to FIG. 4, each of the pixel circuits further includes the second switching unit 2 (i.e., the second switching transistor T3), and the display panel further includes a plurality of sensing lines T and a plurality of second control lines G2. The first electrode of the second switching unit of each of the pixel circuits in the same column is coupled to the same sensing line T, the second switching unit 2 of each of the pixel circuits in the same row is controlled by the same second control line G2, and the second switching unit 2 is coupled between the second node S and the sensing line T.

The data line driving unit 101 supplies a first effective voltage to each of the first control lines G1 to turn on each of the first switching units 1 coupled to the first control line G1, and supplies a first voltage to each of the data lines D to turn on the driving transistor T2 coupled to the first switching unit 1 which is turned on and to keep the light emitting unit 4 coupled to the driving transistor T2 which is turned on being turned off.

The compensation unit 102 supplies the second effective voltage to the second control line G2 coupled to the pixel circuit including the first switching unit 1 which is turned on, such that each of the second switching units 2 coupled to the second control line G2 is turned on.

The detection unit 103 detects the second voltage on each of the sensing lines T coupled to the second switching units 2 which are turned on, and calculates the difference between the first voltage and the second voltage as the threshold voltage of the corresponding driving transistor T2.

The detection unit 103 includes, for example, the differential sample-and-hold circuit and the analog-to-digital conversion circuit. The difference between the first voltage and the second voltage is collected by the differential sample-and-hold circuit, and the difference is converted into a digital signal by the analog-to-digital conversion circuit. The timing during the detection stage is controlled by the timing control chip (TCON).

In one embodiment, during the data writing stage of each row of the pixel circuits, the data line driving unit 101 supplies the first effective voltage to the first control line G1 to turn on each of the first switching units 1 coupled to the first control line G1 and supplies a driving voltage to each of the data lines D. The compensation unit 102 supplies the second effective voltage to the second control line G2 to turn on each of the second switching units 2 coupled to the second control line G2, and supplies the compensation voltage to each of the sensing lines T.

What is claimed is:

1. A method for driving a display panel comprising a plurality of pixel circuits arranged in an array, a plurality of data lines, and a plurality of first control lines, each of the plurality of pixel circuits comprising a first switching unit, a driving transistor, a storage unit, and a light emitting unit, wherein first electrodes of the first switching units of the pixel circuits in a same column are coupled to a same data line, and control electrodes of the first switching units of the pixel circuits in a same row are coupled to a same first control line, and in each of the plurality of pixel circuits, a second electrode of the first switching unit is coupled to a first node of the pixel circuit; the driving transistor has a first electrode coupled to a first power supply, a second electrode coupled to a second node of the pixel circuit, and a control electrode coupled to the first node of the pixel circuit; the storage unit is coupled between the first node and the second node of the pixel circuit; and the light emitting unit is coupled between the second node of the pixel circuit and a second power supply, and the method comprises:

during a data writing stage of the pixel circuits of each row, supplying a driving voltage to the data line corresponding to each of the pixel circuits in a row, and supplying a compensation voltage to the second node of the pixel circuit, wherein in an $i^{th}$ pixel circuit of the plurality of pixel circuits, i is a positive integer, the driving voltage VA[i]=Vdata[i]+Vth[i]+VS, Vdata[i] is an original data voltage of the $i^{th}$ pixel circuit, Vth[i] is a threshold voltage of the driving transistor of the $i^{th}$ pixel circuit, and a range from which a value of the compensation voltage VS is selected is $-Vth_min \leq VS < 0$ wherein Vth_min is a minimum value among all of the threshold voltages of driving transistors of the plurality of pixel circuits of the display panel.

2. The method of claim 1, wherein the value of the compensation voltage VS is set to be equal to −Vth_min.

3. The method of claim 1, wherein the light emitting unit is a light emitting diode.

4. The method of claim 1, further comprising:

obtaining the threshold voltages of the driving transistors of the plurality of pixel circuits; and determining a minimum value among the obtained threshold voltages.

5. The method of claim 4, wherein each of the plurality of pixel circuits further comprises a second switching unit, and the display panel further comprises a plurality of sensing lines and a plurality of second control lines, and first electrodes of the second switching units of the pixel circuits in the same column are coupled to a same sensing line, and control electrodes of the second switching units of the pixel circuits in the same row are coupled to a same second control line, and in each of the plurality of pixel circuits, a second electrode of the second switching unit is coupled to the second node of the pixel circuit, and the step of obtaining the threshold voltages of the driving transistors of the plurality of pixel circuits comprises:

supplying a first effective voltage to each of the plurality of first control lines, to turn on each of the first switching units coupled to the first control line;

supplying a second effective voltage to each of the second control lines coupled to the pixel circuits of which the first switching units are turned on, to turn on each of the second switching units coupled to the second control line;

supplying a first voltage to each of the plurality of data lines for turning on the driving transistors coupled to the first switching units which are turned on and keeping the light emitting units coupled to the driving transistors, which are turned on, being turned off;

reading a second voltage on each of the sensing lines coupled to the second switching units which are turned on; and calculating the difference between the first voltage and the second voltage as the threshold voltage of a corresponding driving transistor.

6. The method of claim 5, wherein the step of reading the second voltage on each of the sensing lines coupled to the second switching units which are turned on comprises:

obtaining a voltage on each of the sensing lines and taking the voltage, a value of which no longer changes, as the second voltage on the sensing line.

7. The method of claim 5, wherein the step of during a data writing stage of the pixel circuits of each row, supplying a driving voltage to the data line corresponding to each of the pixel circuits in a row, and supplying a compensation voltage to the second node of the pixel circuit comprises:

supplying the first effective voltage to the first control line coupled to the pixel circuits in the row to turn on each of the first switching units coupled to the first control line;

supplying the driving voltage to each of the plurality of data lines;

supplying the second effective voltage to the second control line coupled to the pixel circuits in the row to turn on each of the second switching units coupled to the second control line;

supplying the compensation voltage to each of the plurality of sensing lines; and supplying a turn-off voltage to the first control line and the second control line coupled to the pixel circuits in the row simultaneously, to turn off the first switching unit and the second switching unit of each of the pixel circuits in the row simultaneously.

8. The method of claim 5, wherein the first switching unit is a first switching transistor, and the second switching unit is a second switching transistor.

9. A display device comprising a display panel and a driving circuit for driving the display panel, and the display panel comprising a plurality of pixel circuits arranged in an array, a plurality of data lines, and a plurality of first control lines, each of the plurality of pixel circuits comprising a first switching unit, a driving transistor, a storage unit, and a light emitting unit, wherein first electrodes of the first switching units of the pixel circuits in a same column are coupled to a same data line, and control electrodes of the first switching units of the pixel circuits in a same row is coupled to a same first control line, and in each of the plurality of pixel circuits, a second electrode of the first switching unit is coupled to a first node of the pixel circuit; the driving transistor has a first electrode coupled to a first power supply, a second electrode coupled to a second node of the pixel circuit, and a control electrode coupled to the first node of the pixel circuit; the storage unit is coupled between the first node and the second node of the pixel circuit; and the light emitting unit is coupled between the second node of the pixel circuit and a second power supply, and the driving circuit comprises a data line driving unit and a compensation unit, and during a data writing stage of the pixel circuits of each row, the data line driving unit is configured to supply a driving voltage to the data line corresponding to each of the pixel circuits in a row, and the compensation unit is configured to supply a compensation voltage to the second node of the pixel circuit, wherein in an $i^{th}$ pixel circuit of the plurality of pixel circuits, i is a positive integer, the driving voltage VA[i]=Vdata[i]+Vth[i]+VS, Vdata[i] is an original data voltage of the $i^{th}$ pixel circuit, Vth[i] is a threshold voltage of the driving transistor of the $i^{th}$ pixel circuit, and a range from which a value of the compensation voltage VS is selected is $-Vth_min \leq VS < 0$, wherein Vth_min is a minimum value among all of the threshold voltages of driving transistors of the plurality of pixel circuits of the display panel.

10. The display device of claim 9, wherein the value of the compensation voltage VS is set to be equal to −Vth_min.

11. The display device of claim 9, wherein the light emitting unit is a light emitting diode.

12. The display device of claim 9, wherein the driving circuit further comprises a detection unit configured to detect the threshold voltages of the driving transistors of the plurality of pixel circuits, and determine a minimum value among the obtained threshold voltages.

13. The display device of claim 12, wherein each of the plurality of pixel circuits further comprises a second switching unit, and the display panel further comprises a plurality of sensing lines and a plurality of second control lines;

first electrodes of the second switching units of the pixel circuits in the same column are coupled to a same sensing line, and control electrodes of the second switching units of the pixel circuits in the same row are coupled to a same second control line, and in each of the plurality of pixel circuits, a second electrode of the second switching unit is coupled to the second node of the pixel circuit;

the data line driving unit is configured to supply a first effective voltage to each of the plurality of first control lines, to turn on each of the first switching units coupled to the first control line;

the compensation unit is configured to supply a second effective voltage to each of the second control lines coupled to the pixel circuits of which the first switching units are turned on, to turn on each of the second switching units coupled to the second control line;

the data line driving unit is configured to supply a first voltage to each of the plurality of data lines for turning on the driving transistors coupled to the first switching units which are turned on and keeping the light emitting units coupled to the driving transistors, which are turned on, being turned off; and the detection unit is configured to detect a second voltage on each of the sensing lines coupled to the second switching units which are turned on and calculate the difference between the first voltage and the second voltage as the threshold voltage of a corresponding driving transistor.

14. The display device of claim 13, wherein the detection unit is configured to detect a voltage on each of the sensing lines and takes the voltage, a value of which no longer changes, as the second voltage on the sensing line.

15. The display device of claim 13, wherein during the data writing stage of the pixel circuits of each row, the data line driving unit is configured to supply the first effective voltage to the first control line coupled to the pixel circuits in the row to turn on each of the first switching units coupled to the first control line, and supply the driving voltage to each of the plurality of data lines;

the compensation unit is configured to supply the second effective voltage to the second control line coupled to the pixel circuits in the row to turn on each of the second switching units coupled to the second control line, and supply the compensation voltage to each of the plurality of sensing lines; and after the driving voltage and the compensation voltage are supplied, the data line driving unit and the compensation unit are configured to supply a turn-off voltage to the first control line and the second control line coupled to the pixel circuits in the row simultaneously, to turn off the first switching unit and the second switching unit of each of the pixel circuits in the row simultaneously.

16. The display device of claim 13, wherein the first switching unit is a first switching transistor, and the second switching unit is a second switching transistor.

* * * * *